US009157268B2

(12) United States Patent
Fagan et al.

(10) Patent No.: US 9,157,268 B2
(45) Date of Patent: Oct. 13, 2015

(54) COMPOSITE CAPPED STILE, DOOR AND METHOD

(75) Inventors: Gary T. Fagan, Huntersville, NC (US); Matthew D. White, Charlotte, NC (US); Daniel Fulton, Charlotte, NC (US)

(73) Assignee: Masonite Corporation, Tampa, FL (US)

( * ) Notice: Subject to any disclaimer, the term of this patent is extended or adjusted under 35 U.S.C. 154(b) by 811 days.

(21) Appl. No.: 12/023,199

(22) Filed: Jan. 31, 2008

(65) Prior Publication Data

US 2009/0165405 A1 Jul. 2, 2009

Related U.S. Application Data

(60) Provisional application No. 60/899,651, filed on Feb. 6, 2007.

(51) Int. Cl.

| | |
|---|---|
| ***E06B 3/20*** | (2006.01) |
| ***E06B 3/30*** | (2006.01) |
| ***E06B 3/70*** | (2006.01) |
| ***E06B 3/78*** | (2006.01) |

(52) U.S. Cl.

CPC ... *E06B 3/78* (2013.01); *E06B 3/20* (2013.01); *E06B 3/30* (2013.01); *E06B 2003/7069* (2013.01); *E06B 2003/7082* (2013.01); *E06B 2003/7084* (2013.01)

(58) Field of Classification Search

USPC ..... 52/210, 717.01

See application file for complete search history.

(56) References Cited

U.S. PATENT DOCUMENTS

| | | | | |
|---|---|---|---|---|
| 4,130,976 | A * | 12/1978 | Kesseler et al. | 52/656.2 |
| 4,386,482 | A * | 6/1983 | Quinif | 49/489.1 |
| 5,239,799 | A * | 8/1993 | Bies et al. | 52/309.11 |
| 5,497,594 | A * | 3/1996 | Giuseppe et al. | 52/843 |
| 5,732,760 | A * | 3/1998 | Pattison | 160/371 |
| 6,250,040 | B1 * | 6/2001 | Green | 52/656.7 |
| 6,396,010 | B1 * | 5/2002 | Woodward et al. | 200/61.43 |
| 6,665,997 | B2 * | 12/2003 | Chen | 52/800.12 |
| 2005/0011132 | A1 * | 1/2005 | Griffin, Jr. | 49/460 |
| 2005/0019545 | A1 * | 1/2005 | Riebel | 428/304.4 |
| 2009/0165405 | A1 * | 7/2009 | Fagan et al. | 52/204.1 |

OTHER PUBLICATIONS

"PVC", MatWeb Material Property Data, http://www.matweb.com/search/DataSheet.aspx?MatGUID=e19bc7065d1c4836a89d41ff23d47413.*

* cited by examiner

*Primary Examiner* — Ryan Kwiecinski

(74) *Attorney, Agent, or Firm* — Berenato & White, LLC

(57) ABSTRACT

The present invention relates to a capped stile for an entry door having an interior backer element and an exterior cap element secured thereto. The exterior cap element is formed from a moisture resistant, foamed polymer composite and has a specific gravity of about 0.9 or less. A door having the disclosed capped stile, and a method of forming a door, are also disclosed.

1 Claim, 4 Drawing Sheets

COMPOSITE CAPPED STILE, DOOR AND METHOD

CROSS REFERENCE TO RELATED APPLICATION AND CLAIM TO PRIORITY

This application is based on provisional application Ser. No. 60/899,651, filed Feb. 6, 2007, the disclosure of which is incorporated herein by reference and to which priority is claimed under 35 U.S.C. §119(e).

FIELD OF THE INVENTION

The present invention relates to a capped stile for an entry door having an interior backer element and an exterior cap element secured thereto. The exterior cap element is formed from a foamed polymer composite and has a specific gravity of about 0.9 or less. A door having the disclosed capped stile, and a method of forming a door, are also disclosed.

BACKGROUND OF THE INVENTION

Exterior entry doors have traditionally been fabricated from wood. Although wood provides a very satisfying aesthetic appearance, it is prone to rotting; cracking, and splitting. Additionally, wood is expensive and is considered a limited natural resource. For these reasons, the door industry has looked to other materials for fabricating doors. Composite materials are sometimes selected in lieu of natural wood for entry door production. Generally, such doors comprise first and second door facings spaced apart from and parallel to one another. The door facings may be substantially planar, or contoured to include panels and the like. Various techniques are known for providing the door facings with contours and decorative appearances.

The molded door facings are secured to a frame positioned between the facings. The frame typically comprises upper and lower rails at the top and bottom of the door facings, and stiles at the opposite sides of the door facings. The rails and stiles are preferably selected to provide an aesthetic appearance matching that of the door facings. Also, the physical properties of the rails and stiles and other components selected preferably are compatible with the intended uses and environment of the door. For example, a stile is typically used for hinge-mounting a door to a doorjamb. Accordingly, the stile should possess physical properties, such as screw retention properties, consistent with this and other intended uses.

Fiberglass composite door facings were developed as an improvement over traditional wood doors, and resist rotting, cracking and splitting. Although such doors include door facings formed from fiberglass, their stiles and rails are typically formed from solid wood. Wood rails, stiles, and other components exposed to the environment suffer from the same drawbacks mentioned above with respect to traditional wood doors, including rotting, cracking, and splitting.

Conventional polymer rails, stiles, and other door components have been proposed, but often lack the aesthetic and physical properties of wood, exhibit inferior paintability characteristics, and possess poor screw retention. Further, such components are expensive and often have unsatisfactory expansion characteristics. For these reasons, some conventional polymeric stiles have not proven commercial viable.

Other designs provide for edge inserts formed from a relatively inexpensive plastic, such as polystyrene, which are mechanically joined to the door frame. However, the plastic used in such designs tends to melt during door trimming and cutting operations, and therefore has also not proven to be a commercially viable option for many door manufacturing processes.

Still other designs use polymer composites having a relatively high amount of filler materials in order to reduce costs. However, the resulting door stiles formed from such composites are too hard to machine during door processing, and thus have also not proven to be an acceptable design. In addition, the resulting exteriorly exposed surface along the door edges of such designs is often not acceptable in the market.

SUMMARY OF THE INVENTION

The present invention is directed to a door stile or door rail for an entry door having a composite cap. The capped stiles and rails provide for a door having exteriorly disposed surfaces made with a rot-resistant, moisture resistant material. The composite material used to form the capped stiles of the present invention is relatively inexpensive, and preferably possesses a high-heat tolerance that resists melting during machining operations performed during door manufacture, yet is soft enough to machine economically without the need for frequent blade sharpening. The properties and color of the material used to form the exteriorly disposed portion of the disclosed door stiles may be matched to that of corresponding door facings, so that no painting or staining is required. Alternatively, the material forming the exteriorly disposed portions may have a density and coloration suitable for staining or painting.

A capped perimeter frame member for an entry door according to an embodiment of the present invention includes an interior backer element and an exterior cap element. The exterior cap element is secured to the interior backer element. The exterior cap element is formed from a foamed polymer composite and has a specific gravity of about 0.9 or less.

The present invention also relates to a door having a perimeter frame having a pair of stiles and a pair of rails, at least one of the stiles having an interior backer element with an exterior cap element secured thereto. The exterior cap element is formed from a foamed polymer composite having a specific gravity of about 0.9 or less. First and second door facings are secured to opposite sides of the perimeter frame. The exterior cap element defines an exteriorly disposed edge of the door.

A perimeter frame for an entry door or lite for a door or door area is also enclosed. The frame includes a pair of stiles and a pair of rails forming a rectangular frame. At least one of the stiles has an interior backer element and an exterior cap element secured to the interior backer element. The exterior cap element is formed from a foamed polymer composite and has a specific gravity of about 0.9 or less.

A method of forming a door is also disclosed. A perimeter frame is provided having a pair of stiles and a pair of rails. At least one of the stiles has an interior backer element and an exterior cap element secured to the interior backer element. The exterior cap element is formed from a foamed polymer composite and has a specific gravity of about 0.9 or less. First and second door facings are provided. The first and second door facings are secured to opposite sides of the perimeter frame, so that the exterior cap element defines an exteriorly disposed edge of the door. A portion of the exterior cap element is then trimmed to properly size the door.

DETAILED DESCRIPTION OF PREFERRED EMBODIMENTS

Figure 1:
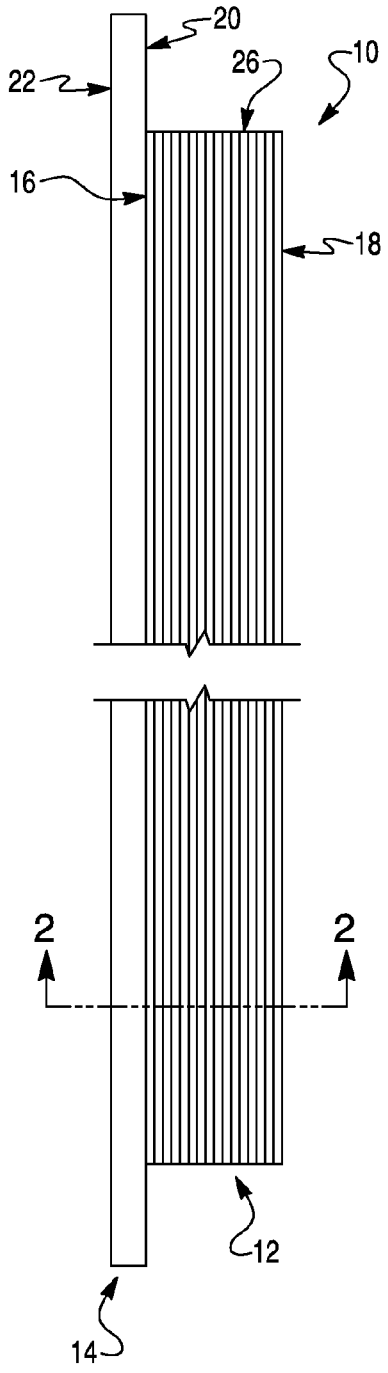
FIG. 1 is a fragmentary front view of a capped stile according to the present invention.
Figure 2:
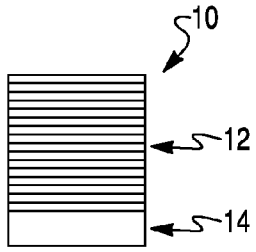
FIG. 2 is a sectional view of the capped stile of FIG. 1 taken along lines 2-2 and viewed in the direction of the arrows.

The present invention is directed to a capped stile or rail for an entry door having an interior backer element and an exterior cap element extending the length of the interior backer element. A capped stile 10 according to an embodiment of the present invention is best shown in FIGS. 1 and 2. Capped stile 10 includes an interior backer element 12, and an exterior cap element 14 secured to interior backer element 12.

Exterior cap element 14 is formed from a rot resistant composite material, such as a polymer composite. Preferably, exterior cap element 14 is formed from a thermoplastic polymer such as polyvinyl chloride (PVC), preferably lead free PVC. Preferably, the PVC is extruded and simultaneously foamed during extrusion to form either exterior cap element 14, or alternatively a sheet of foamed PVC which is cut to form exterior cap element 14. A foaming agent may be added to the composite material prior to extrusion to enhance foaming. Other suitable polymer composites include acrylonitrile styrene acrylate polymer resin and acrylonitrile butadiene styrene polymer resin.

The composite may include a filler material, such as calcium carbonate, talc, or mica. For example, the composite may include at least about 5% by weight calcium carbonate, more preferably between about 5% and about 20% by weight calcium carbonate. However, it is preferred that the composite includes no more than about 20% by weight calcium carbonate, or other like substance, in order to ensure that the resulting exterior cap element 14 is not excessively hard to trim or machine.

Preferably, exterior cap element 14 is formed from foamed PVC, having a softening point of at least about 180° F. and a Brinell hardness at least that of pine, typically about 1.6 HBS 10/100. The foamed composite preferably has a relatively homogenous consistency, with a relatively fine, closed cell structure with no voids. Exterior cap element 14 preferably has a specific gravity of about 0.9 or less, preferably between about 0.7 and 0.9.

We have found that a foamed polymer composite having a specific gravity of less than about 0.8 provides surface qualities having excellent stainability. For example, a relatively low density exterior cap element 14, e.g. having a specific gravity of about 0.75, and having a white or lighter coloration, achieves excellent stainability. The lighter coloration does not compete with the stain color. In addition, as the density of the foamed polymer composite decreases, the ability to absorb and retain stain increases.

A foamed polymer composite having a specific gravity of more than about 0.8 is appropriate for applications wherein exterior cap element 14 is not to be stained, but instead is to be painted or left unfinished. A relatively high density exterior cap element 14, e.g. having a specific gravity of between about 0.85 to about 0.9, provides a smoother surface compared to a lower density material of less than 0.8. Such a surface achieves excellent paintability. Alternatively, a dye may be added to the polymer composite, so that no further staining or painting is required.

Capped stile 10 possesses excellent screw retention properties, preferably having a screw retention value of at least 200 lbs per ASTM D-1037, more preferably greater than 225 lbs.

Interior backer element 12 is preferably formed from a relatively inexpensive material, such laminated veneer lumber (LVL). For example, a multi-ply finger jointed LVL may be used, with the grain direction and joints of adjacent plies staggered. The engineered LVL provides for structural support during forced entry, high wind loads (e.g. hurricane force winds), and resistance to bow due to thermal environmental conditions. We have found that LVL is less likely to warp due to moisture compared to solid wood. Further, LVL resists cracking and splitting compared to solid wood. Alternatively, finger jointed pine or some other suitable wood composite or relatively inexpensive wood may be used. For example, interior backer element 12 may be formed from a plurality of finger jointed LVL pieces, or finger jointed solid wood pieces. Suitable wood species for either the plies or pieces of interior backer element 12 include, but are not limited to, pine such as ponderosa pine or sugar pine, white fir, hemlock, popular, and other relatively low cost species.

Interior backer element 12 includes a first major surface 16 and an opposite second major surface 18. Likewise, exterior cap element 14 includes a first major surface 20 and an opposite second major surface 22. Exterior cap element 14 is preferably laminated to interior backer element 12. First major surface 16 of interior backer element 12 may be adhesively secured to first major surface 20 of exterior cap element 14, preferably using exterior Type 1 glue, such as a moisture resistant polyvinyl acetate or the like. Exterior cap element 14 and interior backer element 12 preferably have an internal bond strength of at least about 75 psi, per ASTM D-1037. However, it should be understood that interior backer element 12 may also be mechanically secured to exterior cap element 14.

The number or plies of LVL and the thickness of each ply forming interior backer element 12 may vary depending on the application and materials used. We have found that LVL having numerous relatively thin plies, e.g. 6 to 20 or more plies having a thickness of about 1/16 inch, is particular suitable for forming interior backer element 12. The plies are adhesively bonded together, such as with polyvinyl acetate or the like, which results in a relatively strong interior backer element 12. In addition, the orientations of the wood grain in adjacent plies preferably differ, which further increases the strength of interior backer element 12.

Figure 3:
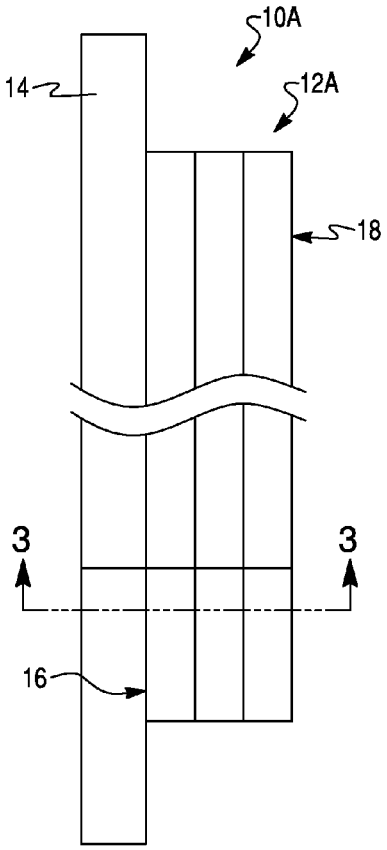
FIG. 3 is a fragmentary front view of a capped stile according to another embodiment.
Figure 4:
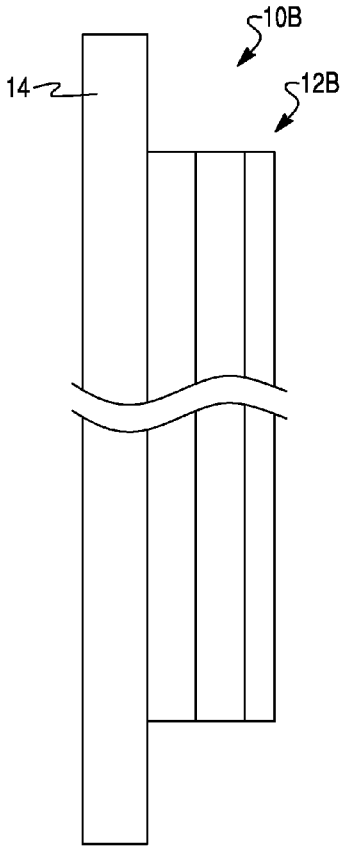
FIG. 4 is a fragmentary front view of a capped stile according to another embodiment.

It should be understood that the number and thickness of plies forming interior backer element 12 may vary. For example, a capped stile 10A having an interior backer element 12A formed from three plies of relatively thick veneer material, for example each having a thickness of about 0.625 inch, may be provided, as shown in FIG. 3. Note that the thicknesses of the plies forming interior backer element 12A (or 12) may be substantially uniform, or vary. For example, a capped stile 10B having an interior backer element 12B may include plies of variable thicknesses such as between about 0.05 inch and about 0.625 inch, as shown in FIG. 4.

Figure 5:
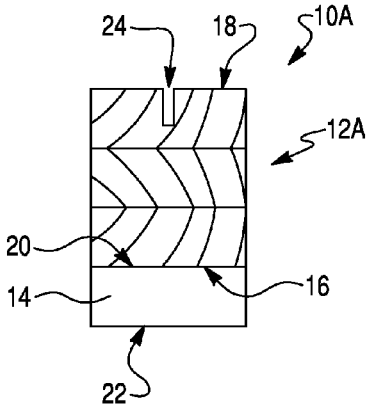
FIG. 5 is a sectional view of a the capped stile of FIG. 3 taken along lines 3-3 and viewed in the direction of the arrows.

In addition, interior backer element 12A of capped stile 10A, or interior backer element 12 of capped stile 10, may include a vent groove 24 extending into second major surface 18, as best shown in FIG. 5.

While interior backer elements 12, 12A, 12B are preferably formed from multiple plies of veneer, it should be understood that the interior backer element may also be formed for a single piece of wood, wood composite, or other suitable material. As such, interior backer element 12 need not be formed from LVL. Thus, the configurations shown in FIGS. 1-5 are exemplary only and the present invention is not so limited.

Preferably, interior backer element 12 (or 12A or 12B) has a thickness greater than the thickness of exterior cap element 14. More preferably, the thickness of interior backer element 12 (or 12A or 12B) is at least twice the thickness of exterior cap element 14, and even three or more times the thickness of exterior cap element 14.

In addition, the overall thicknesses of interior backer element 12 (or 12A or 12B) and exterior cap element 14 may vary depending on the application, and the materials used to form interior backer element 12 (or 12A or 12B) and exterior cap element 14. For example, interior backer element 12 (or 12A or 12B) may have a thickness of between about ½ inch and about 1⅞, more preferably between about 1 inch and about 1⅝ inch. Exterior cap element 14 may have a thickness of between about ¼ inch and about ⅞ inch, more preferably between about ⅜ inch and about ⅝ inch.

Figure 6:
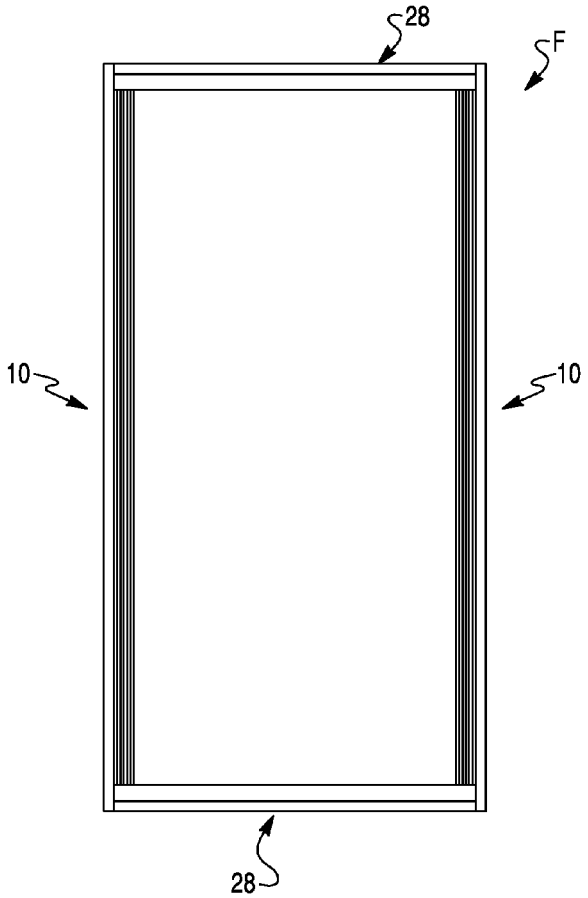
FIG. 6 is a front view of a perimeter frame according to the present invention.

The length of exterior cap element 14 is preferably substantially identical to the length of a longitudinal edge of a door intended to be formed using capped stile 10 (or 10A or 10B). However, the length of interior backer element 12 (or 12A or 12B) is preferably less than the length of exterior cap element 14, as shown in FIGS. 1, 3 and 4. Preferably, exterior cap element 14 extends outwardly from an end 26 of interior backer element 12 a distance substantially equal to the thickness of a rail to be used in forming a perimeter frame F, as best shown in FIGS. 1 and 6. The portion of exterior cap element 14 extending outwardly from interior backer element 12 is preferably substantially perpendicular to end 26 of interior backer element 12.

Figure 7:
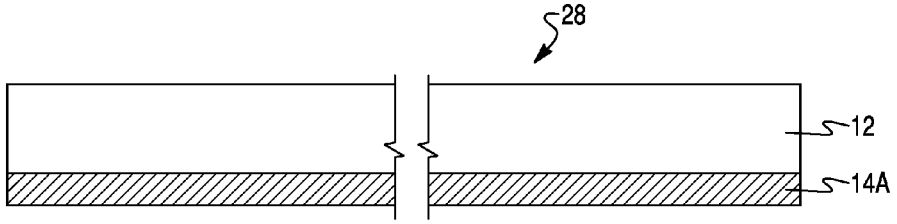
FIG. 7 is a fragmentary front view of a capped rail according to the present invention.

As shown in FIGS. 6 and 7, interior backer element 12 (or 12A or 12B) and an exterior cap element 14A may be used to form a capped rail 28. Exterior cap element 14A is similar to exterior cap element 14, but preferably does not include a portion extending outwardly from interior backer element 12 (or 12A or 12B). As such, capped rail 28 fits against end 26 and the portion of exterior cap element 14 of capped stile 10 (or 10A or 10B) extending outwardly therefrom. Thus, a pair of capped stiles 10 (or 10A or 10B) and a pair of capped rails 28 may be used to form perimeter frame F, which may then be used to form an entry door, sidelite or door lite.

Alternatively, capped stiles 10 (or 10A or 10B) may be used in conjunction with conventional rails, or a conventional rail and a capped rail 28, to form a perimeter frame. For example, a rail formed from solid wood, a polymer composite or a wood composite may be provided. In addition, the bottom rail may include kerfs for accepting a weather sweep, as known in the art.

PVC or some other suitable polymer composite material may be simultaneously foamed as it is extruded to form a substantially flat sheet of foamed PVC having a desired thickness. Typically, PVC has a specific gravity of about 1.1 or more. In the present invention, the specific gravity of PVC is decreased to less than about 0.9, preferably between about 0.7 and 0.9, by foaming during the extrusion process. As such, the density of the foamed PVC decreases, while its volume increases, as it is foamed. Thus, less material is required to form a sheet of foamed PVC compared to a sheet of unfoamed PVC having an identical size and shape, thereby reducing manufacturing costs.

The resulting sheet of foamed PVC is then adhesively attached to a board or sheet of relatively inexpensive LVL, finger jointed wood, wood composite or the like, forming a laminated board or sheet. The laminated board or sheet is then cut into strips having a predetermined width and length to form either capped stiles 10 (or 10A or 10B) or capped rails 28. If capped stiles 10 (or 10A or 10B) are to be formed from the laminated board, the PVC sheet preferably has a length greater than the length of the LVL board or sheet (or other wood or wood composite material), so that the resulting stiles 10 (or 10A or 10B) cut therefrom include exterior cap elements 14 that extend outwardly from interior backer elements 12 (or 12A or 12B).

Figure 8:
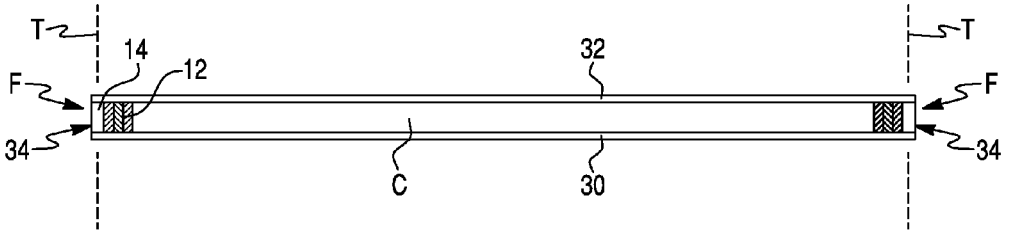
FIG. 8 is a sectional view of a door showing capped stiles of the present invention prior to trimming along trim lines T.

Referring to FIG. 8, first and second door facings 30, 32 are adhesively secured to opposite sides of perimeter frame F, such as through the use of polyvinyl acetate or the like. Preferably, first and second door facings 30, 32 are formed from a fiberglass composite material, such as fiberglass reinforced sheet molding compound. An insulating core material C, such as foamed polyurethane, may also be provided in the space between first and second facings 30, 32.

During door lay-up, a first side of perimeter frame F is aligned with and adhesively secured to the intended interior surface of first facing 30. Core C may then be adhesively secured to first facing within perimeter frame F. Alternatively, a polyurethane foam core may be provided, which is injected into the space between facings 30, 32. The intended interior surface of second facing 32 is then aligned with and adhesively secured to the opposite side of perimeter frame F. The adhesive bond strength between facings 30, 32 and perimeter frame F is sufficient such that facings 30, 32 will not delaminate from frame F. Exterior cap element 14 defines a visible, exteriorly disposed perimeter edge 34 about the resulting door D.

Perimeter frame F may be pre-made prior to door lay-up, having a predetermined length and width. During lay-up, perimeter frame F may proceed through a roll coater, which coats a first side of perimeter frame F with adhesive. Perimeter frame F is pushed along by the roll coater, which helps to eliminate bowing of frame F given frame F is squeezed between the roll coater and a flat supporting surface. Frame F is then aligned with and adhesively secured to first facing 30. Adhesive is then applied to the second side of frame F via another roll coater or sprayer, and optionally to the interior surface of first facing 30 if door D is to include core C. Second facing 32 is then aligned with and secured to the second side of frame F.

Due to possible minor discrepancies in the size and shape of first and second door facings 30, 32, as well as possible minor discrepancies in alignment during the door lay-up process, a portion of the perimeter edge 34 of door D may require trimming. In addition, if capped stiles 10 (or 10A or 10B) and/or capped rails 28 extend outwardly from first and second door facings, the perimeter edge 34 and thus capped stiles 10 and/or capped rails 28 may be trimmed to the desired size.

Figure 9:
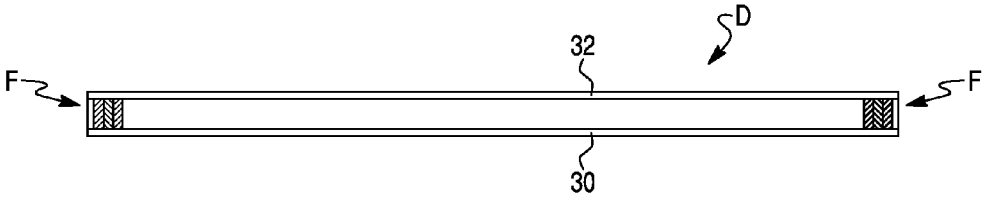
FIG. 9 is a sectional view of the door of FIG. 8 after the capped stiles have been trimmed.

Exterior cap element 14 (or 14A) is preferably sufficiently thick such that a portion of exterior cap element 14 (or 14A) may be trimmed to a desired size. The thickness of exterior cap element 14 used to form capped stile 10 (or 10A or 10B)

is typically greater than the thickness of exterior cap element 14A used to form capped rail 28, given less material is typically trimmed from the top and bottom of the resulting door D compared to the longitudinal sides of the door. The perimeter edge 34 of door D is trimmed, such as by machining with a circular saw, band saw or router, thereby removing a portion of exterior cap element 14 (shown by trim lines T in FIG. 8). A portion of the peripheral edges of facings 30, 32 may also be removed during the trimming process. For example, a longitudinal strip of exterior cap element 14 having a thickness of about 1/16 inch or more may be removed from perimeter edge 34. In this way, clean, aligned perimeter edges of the resulting door D are achieved, as shown in FIG. 9. Any misalignments or other imperfections, such as excess adhesive material which may be present on the edges, is removed during the trimming process.

In this way, the resulting door D has a square edge design, which mimics the look of a solid wood door. Conventional hollow and solid core doors often include tapered edges, which do not look like the edges of many solid wood doors. The trimming process of the present invention provides square edges having a sharp 90° interface with the major face of the door, as provided in solid wood doors. The square edge design of door D is desirable for many consumers and therefore commercially advantageous compared to other conventional designs.

In addition, exterior cap element 14 of capped stiles 10 (or 14A or capped rail 28) is imperious to water and moisture. As such, the resulting door D includes rot-resistant perimeter edges 34. Moreover, door D resists warping due to moisture, given the foamed PVC eliminates moisture pickup.

The use of foamed PVC decreases the amount of material that is needed to form exterior cap element 14, thereby minimizing manufacturing costs. In addition, the foamed PVC is sufficiently hard for resisting damage and wear, having a softening point of about 180° F. This softening point is also sufficiently high such that exterior cap element 14 (or 14A) does not melt when machined during the trimming process.

Due to the relatively uniform consistency and fine cell structure of the material used to form exterior cap element 14, the resulting edges 34 of door D have excellent surface characteristics that are virtually free from visible imperfections even after trimming a portion of exterior cap element 14. Moreover, the fine closed cell structure of the material is virtually free from voids and bubbles, which provides for excellent stainability or paintability. However, the material forming exterior cap element 14 is sufficiently soft such that it may be easily trimmed using conventional machinery, without the need for frequent blade sharpening or expensive blades used for cutting relatively hard materials.

Figure 10:
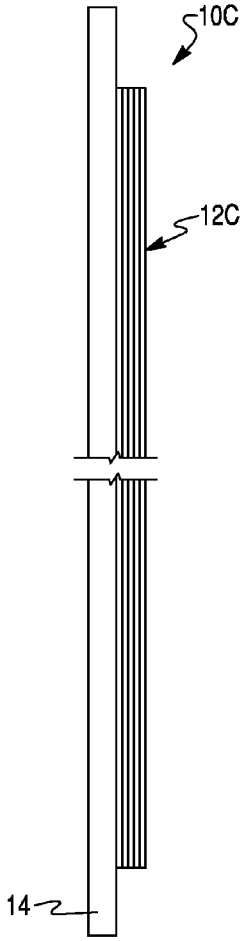
FIG. 10 is a fragmentary front view of a capped stile according to another embodiment.

In addition to entry doors, the capped stiles 10 (or 10A or 10B) and capped rails 28 of the present invention may also be used for other applications such as sidelites for door areas, and other similar applications requiring frame components. For other applications, the thicknesses of interior backer element 12 and exterior cap element 14 may differ from those exemplary thicknesses shown and described above. For example, a capped stile 10C suitable for use in a perimeter frame for a sidelite may include an exterior cap element 14 having a thickness substantially equal to the thickness of an interior backer element 12C, as shown in FIG. 10.

Thus, it would be apparent to one of ordinary skill in the art that various modifications and variations can be made in construction or configuration of the present invention without departing from the scope or spirit of the invention. Thus, it is intended that the present invention cover such modifications and variations, and as hay be applied to the central features set forth above.

We claim:

1. A capped perimeter frame member for an entry door, the capped perimeter frame member comprising:

an interior backer element; and an exterior cap element secured to said interior backer element, said exterior cap element formed from a foamed polymer composite having a relatively homogenous consistency and a closed cell structure with a specific gravity between about 0.7 and 0.8;

wherein said interior backer element includes a first major surface adhesively secured to said exterior cap element and an opposite second major surface; and further comprising a vent groove extending into the second major surface.

* * * * *